United States Patent [19]

Bobak et al.

[11] 4,328,492

[45] May 4, 1982

[54] AUTOMATIC DISPLAY SYSTEM AND PROCESS

[76] Inventors: Tadeusz Bobak; Tadeusz C. Bobak, both of 540 San Vicente Blvd., Santa Monica, Calif. 90405

[21] Appl. No.: 72,972

[22] Filed: Sep. 6, 1979

[51] Int. Cl.[3] ..... G08B 5/36

[52] U.S. Cl. ..... 340/764; 340/373; 340/798; 340/793; 340/706

[58] Field of Search ..... 340/764, 373, 793, 798, 340/752; 358/230

[56] References Cited

U.S. PATENT DOCUMENTS

| | | | |
|---|---|---|---|
| 3,178,699 | 4/1965 | Burton | 340/798 X |
| 3,267,595 | 8/1966 | Levy et al. | 340/764 X |
| 3,307,170 | 2/1967 | Aoyama et al. | 340/703 |
| 3,469,258 | 9/1969 | Winrow | 340/764 X |
| 3,482,344 | 12/1969 | Holloman | 340/764 X |
| 3,486,258 | 12/1969 | Mueller | 340/764 X |
| 3,941,926 | 3/1976 | Slobudzian et al. | 340/793 X |
| 4,177,458 | 12/1979 | Wakatake | 340/764 X |
| 4,194,198 | 3/1980 | Baer et al. | 340/798 X |

*Primary Examiner*—David L. Trafton

*Attorney, Agent, or Firm*—Ostrolenk, Faber, Gerb & Soffen

[57] ABSTRACT

An image display system and process are disclosed. The image display system comprises a generally flat display screen which is subdivided into a plurality of display mode modules, each display module being composed of a plurality of display elements. Each display element allowing the display of an image dot, comprises a plurality of display sub-elements which are hollow cylinders, having a dark half surface and a clear half surface, rotatable by 180°. Electromagnetic means are provided to actuate all display sub-elements for resetting and setting of the image. The display sub-elements of an element provide the display of the grey values of said dot.

The electromagnets of each module are controlled by a binary digital control unit.

14 Claims, 11 Drawing Figures

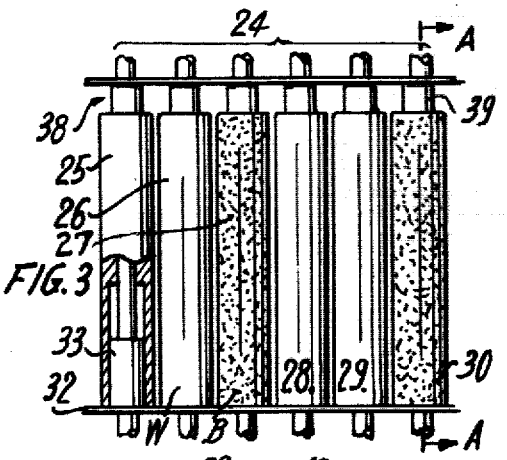
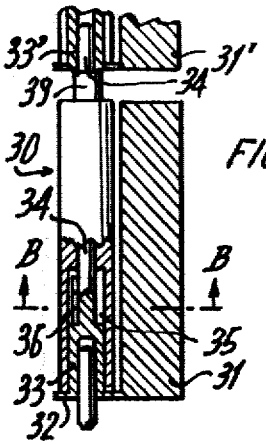
FIG. 5
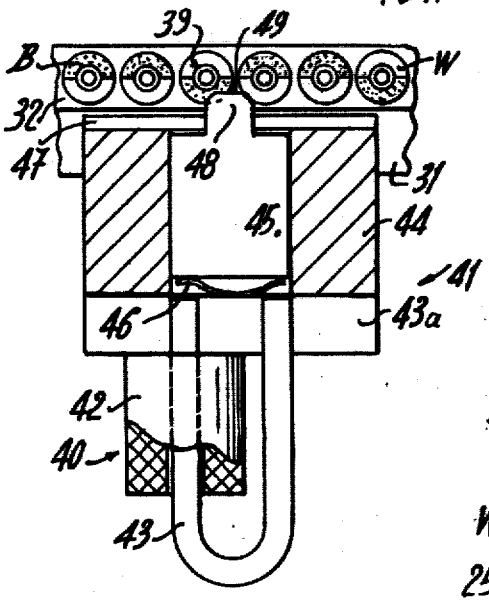
FIG. 4
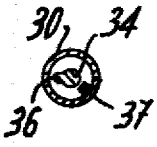
FIG. 6
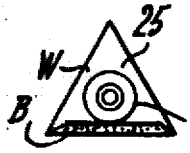
FIG. 8
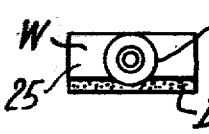
FIG. 8A

AUTOMATIC DISPLAY SYSTEM AND PROCESS

BACKGROUND OF THE INVENTION

This invention relates to an image display system. More particularly, the invention relates to an image display panel or screen which is automatically actuated to display different or varying images of all kind of visible information like portraits, objects, scenes, alphanumeric information in a long or short lasting manner. The invention further relates to an image display process.

Devices for displaying different images are known in the art. Thus, U.S. Pat. No. 3,273,140 discloses a display panel equipped with a multitude of lamps which are partially lighted according to a program so that an image can be formed by the combination of illuminated and dark lamps. Furthermore, a similar device has been known from U.S. Pat. No. 2,239,522 where color lamps are used, and from U.S. Pat. No. 3,210,757. Another kind of display panel has been proposed in U.S. Pat. No. 3,270,447. In this patent, the display screen is divided into a multitude of cells wherein a reflector is provided in each such cell, the reflectors being able to be moved at different depths in their respective cells by means of solenoids having multiple windings.

From U.S. Pat. No. 3,486,258, a display means for displaying moving pictures is known wherein display elements are mechanically transported behind a panel.

In U.S. Pat. No. 3,482,344 a display panel is described wherein flat display members, rotable about 180°, are provided; to set and reset an image, the whole panel must be moved from one station to another where the members are moved by fluid motions.

These known devices suffer from the serious disadvantage that their electrical energy requirements are tremendously high; furthermore, they are quite expensive to manufacture, and in display panels using electric lamps, maintenance problems are severe since lamps must often be replaced, and replacement is not easy. The lighted spots in lamp display panels further do not cover the entire surface of the panel since the lamps have a circular front area.

Other known display devices are by far too expensive or too complicated for practical use.

An effective and rapidly working dot image display system and process has been disclosed by us in in the copending U.S. patent application Ser. No. 942,972, now U.S. Pat. No. 4,186,394, the contents of which has not yet been published anywhere. This application is incorporated by reference into the present application.

It is therefore an object of the present invention to provide a novel display panel or screen which is automatically actuated to selectively exhibit different visible information like images of persons, scenes, signs, advertisements, etc.

It is a second object of the invention to provide a display system which is perfectly visible in normally or artificially lighted rooms like halls, airport lounges, etc., and which can also be used as a daytime outside display.

It is a further, important object of the invention to provide a display system capable of showing images comprising the so-called half tone reproduction.

It is another object of the invention to provide a display system similar to a dot matrix where the individual dots cannot be distinguished by the naked human eye, the displayed image thus appearing as a continuous dot-free pattern.

Still a further object of this invention is a display panel composed of modules, each module comprising a plurality of elements which are each composed of display sub-elements, thus speeding up the image setting and resetting operations.

A still further object of the invention is to provide such modules, elements and sub-elements which are very simple and inexpensive but are working with perfect reliability.

It is another object of the invention to provide a process for displaying images wherein, when a particular and predetermined image has been displaced, the next one can be displayed by resetting said image and setting a new one simultaneously with the read-out of data from a data carrier so that no pre-setting of a new image is necessary, thus speeding up the sequence of images to be displayed in intervals.

BRIEF SUMMARY OF THE INVENTION

In accomplishing the above objects of the invention, there is provided a display system comprising a generally flat display panel being subdivided into display modules, each display module being composed of a plurality of display elements. Each display element is subdivided into several display sub-elements, called DSE's.

These DSE's are disposed in substantially adjacent relationship, and a group thereof forms said display elements. Each display element displays a dot of the image, and the grey values are produced by the combination of "white" and "black" surfaces displayed by each one of the DSE's of one group. Each DSE is rotatably mounted on an axis; all axes of the whole display panel are lying in the same plane, that of the panel, and are parallel to each other.

The DSE's of one module are disposed in rows and columns. Horizontal supporting bars rotatably support the corresponding DSE row. The DSE's are cylinders having a "black" half surface and a "white" half surface; they can be rotated by 180° about their axes by means of an actuating neck. Electromagnets, one for each DSE row, are vertically lodged in a control bar. A slider having a tongue which protrudes in direction to the DSE actuating necks is biased by a flat spring against the neck; this slider is retracted and the torque cannot touch the neck when the electromagnet is energized. The control bar travels horizontally behind the panel; during reset, the tongue contacts successively the necks of all DSE's of a row and rotates them in the corresponding direction by 180° so that all DSE's display their black side. If a DSE is already in the "black" position, the tongue slides over its control neck without rotating the DSE since this DSE is latched in its "black" position by an internal nose being in contact with a stop abutment.

In order to set an image, the control bar of each module travels in the reverse horizontal direction. Electric pulses, supplied by a control circuit which reads out image information from a suitable carrier, are transmitted to an electromagnet when a particular DSE must not be turned from "black", the reset condition, to "white", just before the corresponding tongue reaches the actuating neck of the respective DSE. The magnetic force retracts the tongue, and its frontal face does not touch the actuating neck of said DSE.

In this manner, the whole image is set by setting simultaneously the fractional image in every module.

Other objects and characteristic features of the invention will become apparent as the description proceeds.

BRIEF DESCRIPTION OF THE DRAWINGS

Therefore, the invention will be better understood and objects other than those set forth above, will become apparent when consideration is given to the following detailed description of the preferred embodiment thereof. It should be understood that the invention is not limited to the precise arrangements and instrumentalities shown.

Such description makes reference to the annexed drawings wherein

FIG. 3 is a front view of one display element, showing it subdivision in sub-elements, FIG. 4 shows a top view of the element of FIG. 3, the upper bearings of the display sub-elements not being shown, FIG. 5 is a side view of the element of FIG. 3, partially sectioned in the plane A—A of FIG. 3, FIG. 6 is a sectioned view of the element of FIG. 5, in the plane B—B, FIGS. 8 and 8A show top views of other pratical embodiments of sub-elements.

DETAILED DESCRIPTION OF THE INVENTION

The display system of the invention provides a continuous, substantially dot-free image or pattern. The theoretical optical basis therefor is illustrated in FIG. 1.

It is well known that the human eye cannot distinguish two dots as such which have a distance from each other less than about 0.1 mm at the normal visual range, i.e. at about 25 to 30 cm.

Figure 1:
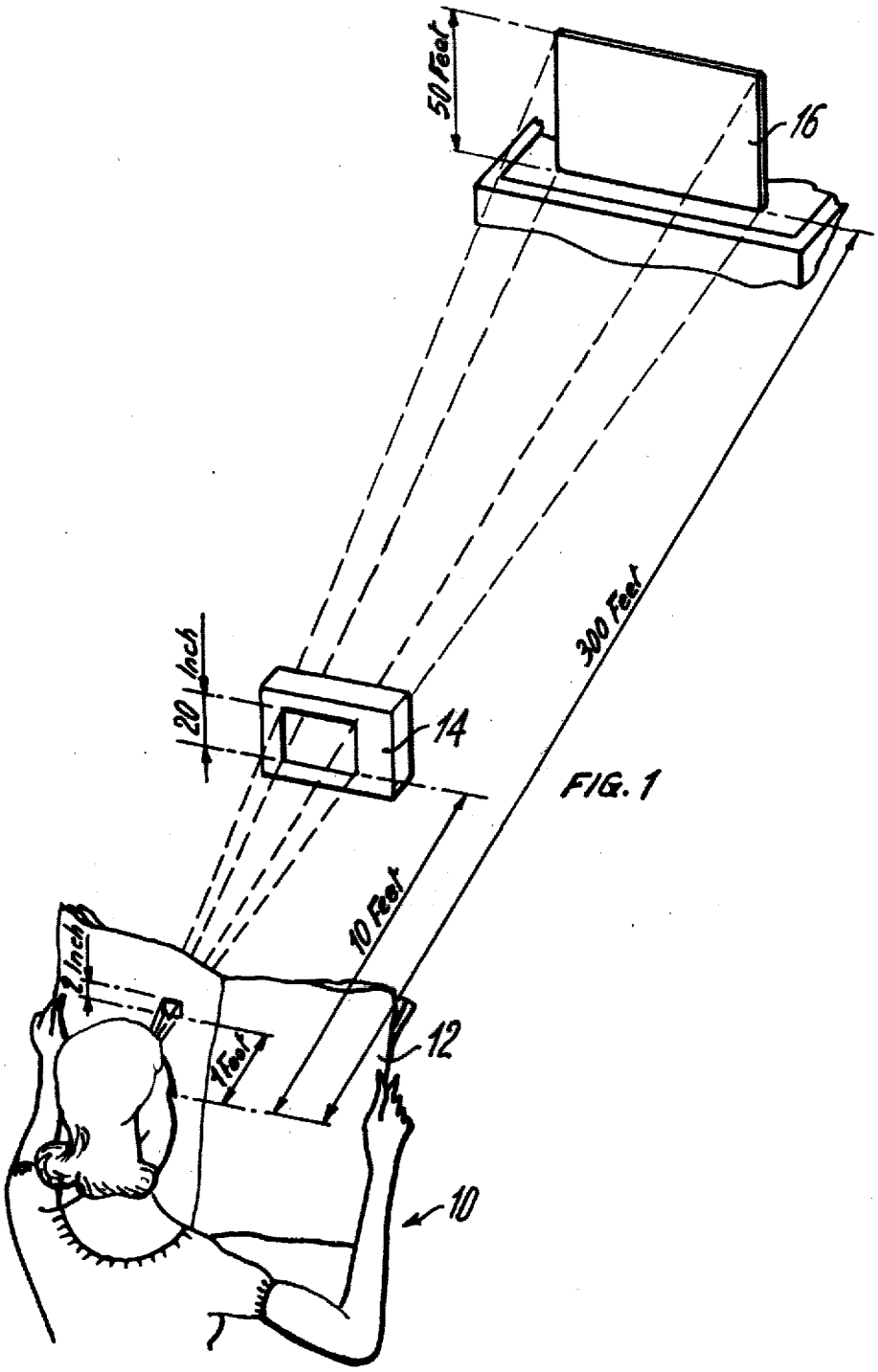
FIG. 1 is a schematic perspective view to illustrate the optical basis of a large size display.

In FIG. 1, the reader 10 holds a newspaper 12 at the visual distance of 1 foot. She looks at a picture being about 2 inches in height. The newspaper picture is composed, in a conventional manner, of dark and light dots having a distance, in the picture plane, of less than about 4 mils (0.1 mm) so that the picture appears as a continuous one. This picture remains continuous, if it is shown on a TV screen 14, about 20 inches (50 cm) high, when a visual distance thereto of about 10 feet is selected, although its dark and light dots are greater. On the TV screen, 625 lines are displayed so that the distance between two adjacent lines is 50:625=0.08 cm or 0.8 mm. Since the visual distance is 10 feet (3.14 m), the TV picture gives the same continuous visual impression as a newspaper picture of 2 inch at 1 foot; the apparent distance between two adjacent vertical dots (corresponding to the TV picture lines) will be 0.8:10=0.08 mm, a value inferior to the resolution limit of 0.1 mm (at the normal visual range). Now, if a display panel 16 is seen at a distance of 300 feet, a dot distance of 0.1 mm in the normal visual range (1 foot) will correspond to a dot distance and, at the same time, to a dot diameter of $0.1\times300=30$ mm. Therefore, if the display on panel 16 should be composed of dark and light dots or elements having a linear dimension in the panel plane of not more than 30 mm (i.e. between $1\frac{1}{8}$ and $1\frac{1}{4}$ inches), the thus formed image will appear continuous to the viewer at a visual distance of 300 feet or more.

The display panel of the invention takes advantage of this fact in having its surface divided into elements which may have a height and width of only about 10 mm (i.e. about 0.4 inch). Images on such a panel appear continuous at a visual distance of only 100 feet (or greater). At shorter distances, the image appears slightly dotted but still perfectly recognizable.

Figure 2:
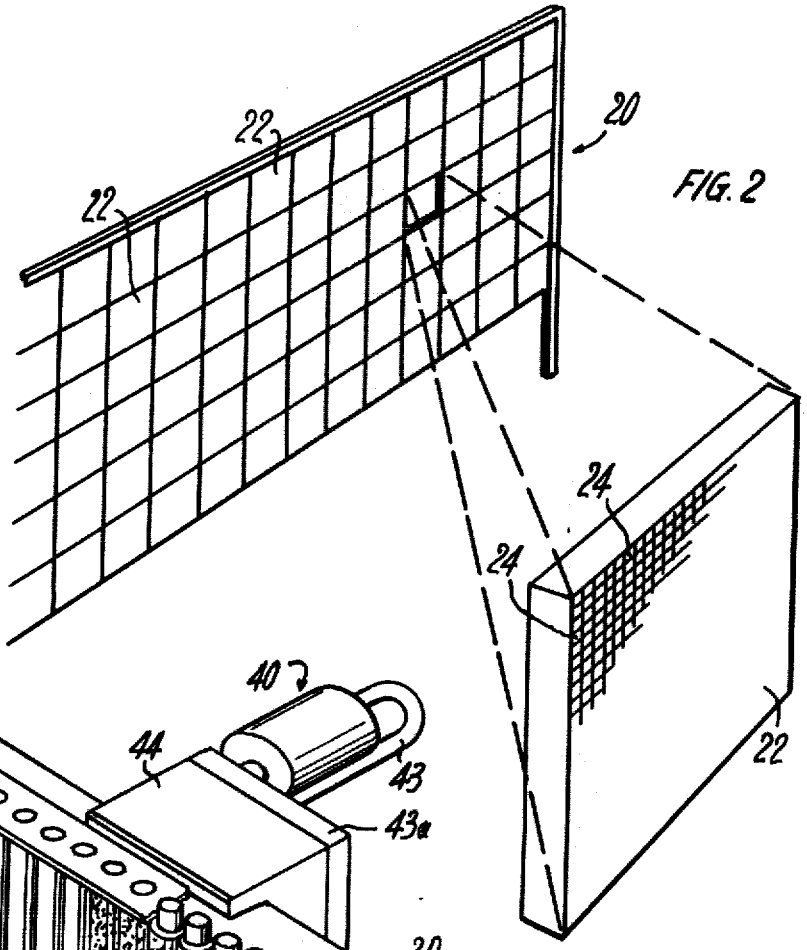
FIG. 2 is a schematic perspective view of the general construction of the display panel, viewed from its front.

The general arrangement of the display panel is shown in FIG. 2. The large display panel or screen 20, having dimensions of about 2 to 15 m high and 4 to 30 m wide is subdivided into a plurality of identical modules 22. Preferably, each module has a dimension of $50\times50$ cm. All modules 22 are of the same construction which is described below. Each module 22 is composed of a plurality of identical display elements 24 which are also described below. Each display element 24 consists of a small number of display sub-elements; this number is selected in response to a certain selected grey value scale and can be changed as desired; this will be explained later. Thus, the display panel 20 comprises an array of display sub-elements.

Such an element 24, having in this instance six sub-elements, is shown in FIG. 3 in a front view and in FIG. 5 in a cross-section in the plane A—A of FIG. 3; a top view thereof is represented in FIG. 4.

Before the operation of the elements 24 or the module 22 will be described, the arrangement thereof should be briefly discussed.

Each element 24 is composed of six display subelements (in the following abreviated by "DSE") 25, 26, 27, 28, 29, 30 having in FIGS. 3 to 7 the form of cylinders or rollers. Each DSE has a dark or black half B and a clear or white half W, and mesns are provided to rotate the DSE in such a manner that either the dark (black) or the clear (white) half is displayed. The diameter-to-height ratio of these rollers 25 to 30 is about 1:6 so that an element formed of six DSE's has about a square front surface, as shown in FIG. 3. The height of one DSE is about 5 to 20 or even 30 mm, a height of about 10 mm being presently preferred for good resolution of the displayed picture.

The reason why each element 24 is preferably divided into six sub-elements 25 to 30 is the following:

Pictures formed of deep black spots or dots on white ground appear harsh and do not show any tridimensional effect. However, if half tones are introduced, the picture becomes smooth and appears to be plastic or tridimensional. The preferred embodiment of the invention makes it possible to obtain this plastic effect by introducing half tones.

In the system herein described, seven gradations between white and black were selected. Referring now to FIGS. 3 and 4, a fully white color of the spot represented by the element 24 is obtained when all six DSE 25 to 30 display their white half surface W. This corresponds to grade "WHITE" of the grey scale. Now, when DSE 27 is rotated by 180°, 5/6 of the total element surface appears white and 1/6 appears black, DSE 27 showing its black surface B. This represents "GREY 1" on the grey scale.

In the following Table 1, the grey scale grades depend from various positions of DSE's 25 to 30. In this Table, the letter "W" indicates that the respective one of DSE's 25 to 30 is in its rotated (set) or white position, displaying its white half surface, whereas "B" indicates that the DSE is in its non-rotated or reset position, where it is showing its black half surface.

TABLE 1

| DSE position* | | | | | | Brightness | Luminosity | Binary | Impulsion |
|---|---|---|---|---|---|---|---|---|---|
| 25 | 26 | 27 | 28 | 29 | 30 | grade | % | code | code |
| W | W | W | W | W | W | WHITE | 100 | 000 | IIIIII |
| W | W | B | W | W | W | GREY 1 | 83 | 100 | IIOIII |
| W | B | W | W | B | W | GREY 2 | 67 | 101 | IOIIOI |
| W | B | W | B | W | B | GREY 3 | 50 | 110 | IOIOIO |
| B | W | B | B | W | B | GREY 4 | 33 | 011 | OIOOIO |
| B | B | W | B | B | B | GREY 5 | 17 | 001 | OOIOOO |
| B | B | B | B | B | B | BLACK | 0 | 111 | OOOOOO |

*B = black W = white

It is obvious from this Table 1 that all grades of the selected seven-step grey scale and thus all desired half tones can be represented and displayed by an appropriate combination of fully white and fully black surfaces, as it will be described in detail later.

The display element 24 to be described now in detail is shown in FIGS. 4, 5 and 6.

In the embodiment shown in FIGS. 2 to 7, the display panel 20 is composed of a plurality of modules 22 each of which being able to display part of the whole image.

Each module 22—wherein the display sub-elements (DSE) can be set and reset by a module sub-control—is composed of 2500 elements 24; each module has the dimensions of 60×60 cm, 50 elements 24 being arranged in 50 rows. It appears that these numbers—there are 15000 DSE's per module—are the practical maximum to be reached at present. Of course, if the display panel 20 should be placed at a distance of more than about 20 to 30 m from the viewer, the sub-elements can be made greater.

A horizontally arranged supporting bar 31 is provided at its lower extremity with a horizontally extending, protruding rail 32. This rail 32 has upwardly standing cylindrical supporting studs 33. Preferably, parts 31, 32 and 33 are made of plastic in one piece.

Each supporting stud extends by a thin elongated cylindrical stem 34 which goes into the hollow supporting stud 33' of the vertically adjacent supporting bar 31' (see FIG. 5) when the module is assembled. Thus, all horizontal supporting bars 31 of a module are automatically adjusted (see FIG. 7).

The DSE's of FIGS. 3 to 7 are hollow cylinders; the six DSE's of one element 24 bearing the reference numerals 25 to 30 (see FIG. 3). Since all DSE's of the whole display system are identical, the description of one of them is deemed to be sufficient.

The DSE has two bores: The upper half has a bore, fitting with the stem 34, and the lower half is provided with a bore 35 of greater diameter which receives the supporting stud 33. The DSE or roller 30 thus can freely rotate about stud 33 and stem 34. However, the stem 34 is provided at its portion adjacent the stud 33 with an exceptional abutment 36, and in the same horizontal plane, the inner surface of the bore 35 of the DSE has a nose 37, see FIG. 6. The circumferential extension of the nose 37 (which is some 10 to 15 degrees in FIG. 6) is normally such as to limit the rotational movement of the DSE to an angle of about 180°, as to be described later.

The DSE has about the same height as the supporting bar 31. There is a gap 38 between vertically adjacent supporting bars 31, see FIGS. 5 and 7. Within the gap forming space 38, the DSE 30 is provided with a cylindrical operating neck 39. The operating necks of all DSE's of a row are lying in the same horizontal plane, a plane which can be defined by the gap 38.

In a typical embodiment, the DSE's have a diameter from 1.6 to 2.0 mm and a height of about 10 mm. The gap 38 has a height of about 2 mm. However, these dimensions may also be greater.

In front of each gap 38, but on the vertical rear surface of the module 22 (see FIG. 7), there is an electromagnetic device 40 for setting and resetting of the DSE's. A vertically extending control bar 41 bears a plurality of electromagnets 42 having a horse-shoe shaped armature 43 which traverses the rear cover **43*a* of the control bar 41. The number of electromagnets is of course the same as that of the horizontal gaps 38 or of the horizontal rows of DSE's. In the body 44 of the control bar 41, a contact blade 45 is slidably journalled and biased by the blade spring 46 against the front cover 47 of the control bar 41. A tongue 48 traverses a corresponding slot in the front cover 47. The length of the tongue 48 is such that its front face 49 comes in frictional contact with the necks 39 of the DSE's (e.g. 30). The horizontal length of the front face 49 is about the same (or somewhat greater) as half of the circumference of the neck 39**.

Figure 7:
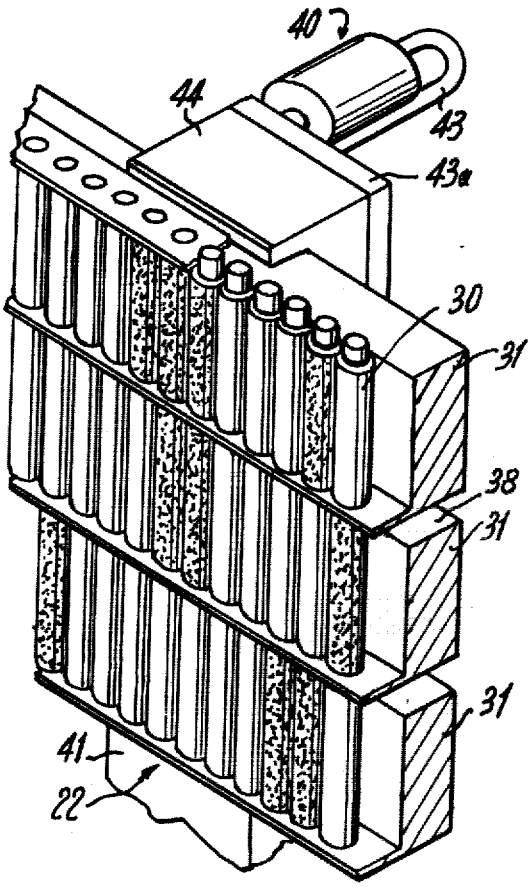
FIG. 7 is a perspective view of part of a display module of FIG. 2, showing also schematically the electromagnet setting arrangement.

The vertical control bar 41 is mounted in such a manner that it can rapidly slide in both transverse horizontal directions behind all panel forming supporting bars 31, see FIG. 7.

In FIGS. 3 to 7, the display sub-elements (DSE) have cylindrical form, half of the lateral surface of the cylindrical DSE is black (B), and the other half is white (W). However, the DSE may have any other prismatical form desired, e.g. a triangular section (FIG. 8) or a flat rectangular one (FIG. 8A). All other section shapes of prisms can also be used.

The different steps of the forming of an image and its display will now be described.

During the operation, the vertical control bar 41 will be moved in both horizontal directions. The means for effecting said movement are not represented in the drawings; however, it can be arranged as described in detail in our copending U.S. patent application Ser. No. 942,972 which is incorporated herein by reference.

In the starting condition, all DSE rollers (e.g. 30) are set in such a way that their black halves appear on the front of the module 20. In these conditions, all modules (and thus the whole panel) are seen by an outside viewer as black squares.

The control bar 41 is in the extreme left position. From here it travels rapidly in continuous motion to the right side of the module. If none of the electromagnets 40 is energized, the tongues 48 of the blades 45 enter into contact with the operating necks 39 thus turning the rollers by 180 degrees. These half-turned rollers are showing now their "white" halves on the surface of the module. The rotation is stopped after 180° since the nose 37 (FIG. 6) comes into contact with the stop abutment 36, or because the length of surface 49 is equal to half the circumference of the cylindrical neck 39. If during this travel of the control bar 41 to the right some of the electromagnets 42 are energized while passing behind a column of rollers, the corresponding blades 45 are retracted towards the horseshoe armature 43 of the magnets. The tongue 48 then passes behind the neck 39 of the corresponding DSE roller without its face 49 touching the neck. As a result, the corresponding DSE remains in "black" position.

When the control bar 41 reaches the extreme right side of the module 20, it stops there leaving behind in accordance with the program (to be discussed later) all rollers in their dual (black or white) positions. This operation formed a pattern or picture on the surface of the module. The control bar 41 remains now on the right side of the module for a time programmed to observe the picture.

Subsequently the control bar 41 returns to its extreme left position "erasing" the picture. During this travel back no electromagnet is energized, and all blades 45 remain with their tongues 48 in their projected positions entering in contact with the operating necks of all DSE rollers. Those rollers which were in the previous travel of the control bar turned to their "white" position are now turned back to their "black" position. Blades 48 which enter in contact with operating necks of rollers which remained in their "black position" are frictionally sliding on the necks' surfaces without turning the rollers since the tooth 37 of these DSE is in contact with the corresponding stop abutment 36 (FIG. 6). When the control bar 41 returns to the initial left side of the module, all rollers are again in their "black" position, and this is the end of the picture-forming cycle. The next picture cycle may start in the same way as the previous one, setting on the module a new picture or pattern. The electric impulses which indirectly are causing the formation of the picture are emitted to the electromagnets from a control unit.

Each module has its own control unit which is programmed for various pictures by its individual program device, e.g. a cassette. Different pictures displayed at the same time on all modules belonging to the same panel represent subsets of the total picture displayed on this panel. Readings of pictures registered in codified form on the tape of the program device are converted by the control unit to electric impulses which in turn are distributed to respective electromagnets determing "black" or "white" positions of corresponding rollers. This reproduces the original picture on the panel.

The Control Unit has also a build-in program which determines the sequence of operations in each picture's cycle.

There could be many program devices like: magnetic tapes, magnetic disks, magnetic cards, paper tapes, etc. In this description we mentioned magnetic tape in a form of a pluggable cassette.

An original picture to be registered on the tape is scanned in a densitometer into fifty vertical lines (columns). Each column is subdivided into series of fifty points. The luminosity of each point is registered in seven grades: black, white and five grades of grey. Registration is done in a binary form (see Table 1). Decodification of this binary code, point by point for each of fifty columns, is done by the Control Unit.

The preferred method and apparatus for effecting the imaging operation as already shortly mentioned above, will be described in a summary manner. Electronic parts and devices used therein are familiar to the one skilled in the art. These devices are conventional, commercially available ones and will therefore not be described in detail.

Figure 9:
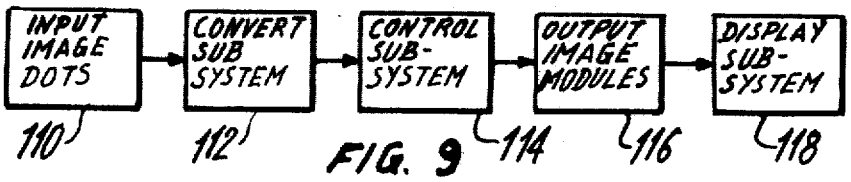
FIG. 9 represents schematically the flowsheet of the imaging and display control systems.

The general design of the display process is schematically shown in FIG. 9. All the individual parts will be described below.

Device 110 is a photoelectric device which scans an imput image and resolves it into dots. Each dot is associated with a binary information as to its brightness, e.g. with one of the data "white" and "black". Device 110 stores all dot data in a memory. However, images can also be produced artificially, e.g. by a computer, a typewriter or similar systems. In this case, the input device 110 converts this crypto-image or code image information into the necessary image dot information.

The device 110 transmits its information to the convert sub-system 112. In this system, the memorized image dot information from device 110 is converted into a form which can control the modules of the display panel. The convert sub-system 112 also divides the total image data into individual programs of the respective modules.

These individuals programs are plugged into the respective control sub-systems 114 which are built in each module. The systems comprise approriate amplifier means the outputs of which energize directly all magnets 42 in each module. System 114 also comprises amplifier and actuating means for driving the control bar 41 behind the panel (FIG. 7) as well as synchronizing means in order to synchronize the movement of the control bar 41 with the energizing of magnets 42, and timing means for accomplishing the appropriate sequence of the operation steps described above and for their repetition. The signals produced in device 114 are transmitted to the individual magnets 42 representing sub-system 116; their function and operation has already been described.

Figure 10:
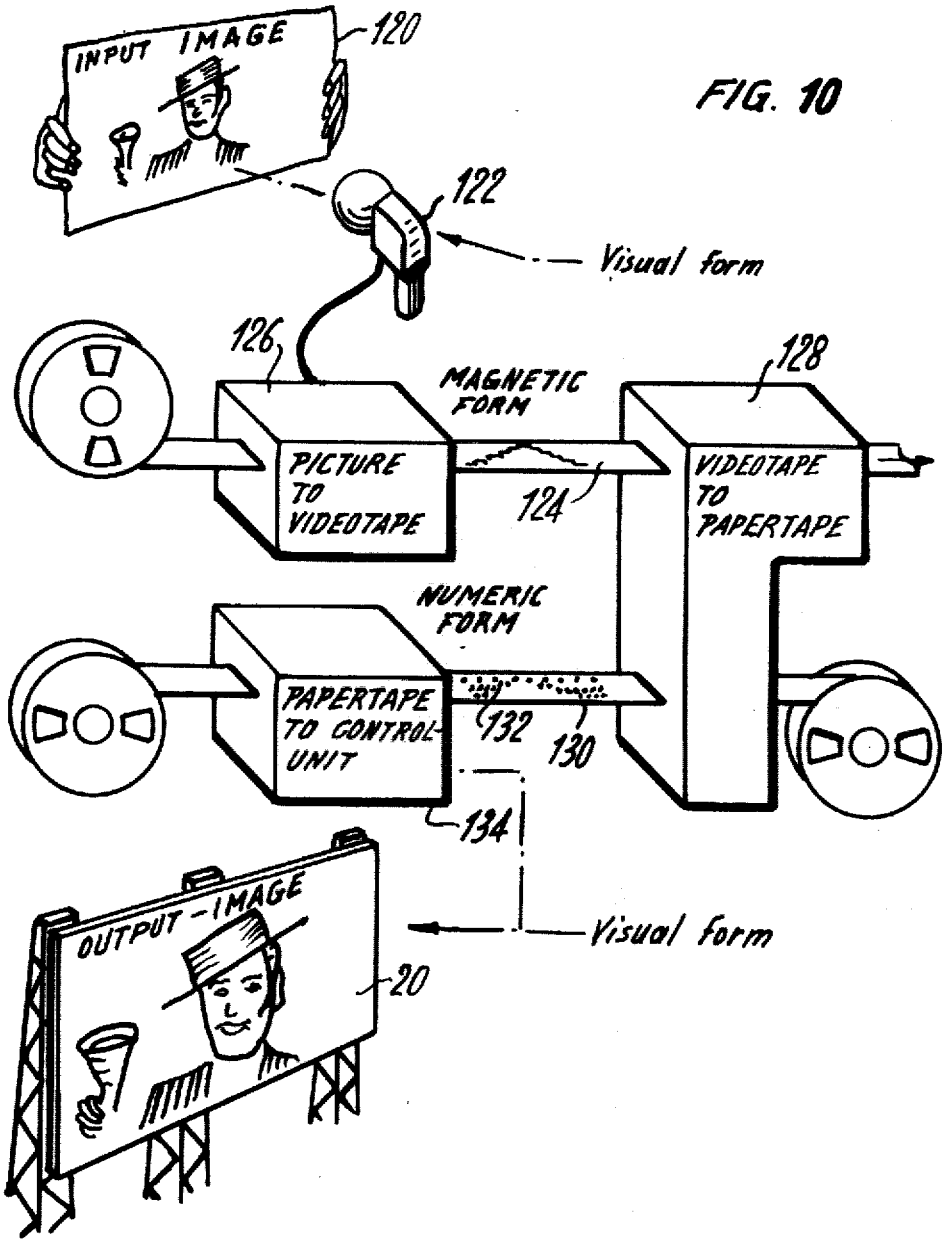
FIG. 10 is a schematical view of the method of transforming an image pattern into the corresponding identical display.

An embodiment of the display process of the invention is represented in FIG. 10.

An input image, having for instance a dimension of $20 \times 30$ cm, is scanned by an optical scanner 122 which "reads" the image line by line and resolves each line into dots, substantially like a television camera. The total number of dots is equal to the number of display elements 24 in the display panel 20 (FIGS. 1 and 3). The scanner 122 equipped with a densitometer produces dot sequence data and, for each dot, data related to its grey value. All these data are recorded on a video tape 124 in magnetic form by the optical-to-magnetic converter 126 well known in the art. Then, the so obtained recorded magnetic tape or videotape 124 can be stored, or it is fed into the magnetic-to-numerical converter 128. This converter transforms the magnetic information in numerical, binary data; in FIG. 10, this converter 128 produces for example a paper tape 130 with punched holes 132. This paper tape 130 is then fed into the control converter 134 which transmits the numerical data to a display panel control unit (not shown) which transforms the numerical data into output pulses for driving and energizing the mechanical, electrical and magnetical means of the display panel modules already described. An example of the binary data for the grey values and the impulsion code to be transmitted to the magnets 42 (the latter is worked up in display sub-system 118) has been already given in Table 1 above. Finally, the output image appears on the display panel 20 of the invention.

The optical converter 126 controls the scanning operation of the scanner 122. Converter 126 contains a ROM circuit in which the module data are stored. When scanning the input image 120, information must be transmitted to the scanner 122 as well as on the magnetic tape 124 when the horizontal and vertical borders of a display module are reached. Now, the scanner 122 can be arranged to scan the input image portionwise, corresponding to the modules on the display panel 20, or it may scan the input image line by line. In the first case, all dot information associated to a particular module will be recorded on a predetermined short length of the tape 124. In the second case, each scanned line and line portion appertaining to a particular module will be "labelled" by additional module identification data, and these identification data will permit the converters 128 and 134 to correctly command all modules simultaneously.

The information data related to the grey value of each image dot is treated in a similar manner. The six sub-elements 25, 26, 27, 28, 29 and 30 of each element 24 (see FIGS. 3 and 4) will be actuated for showing "black" or "white" exactly according to Table 1 above. For instance, if a particular dot, say dot no. 1165 in module no. 5, is read by the scanner 122 to have a grey value of 3, this value is recorded as "110" on tape 124 together with the dot information 1165 and the module identification 5. The converter 128 punches then on the paper tape 130, in the band appertaining to module no. 5, holes according the pattern "IOIOIO" for energizing magnet 42 for rotating the sub-elements 25, 27 and 29 of display element no. 1165. When the respective magnet will then have been energized three times on module no. 5 during the image preforming step described above, the DSE's 25, 27 and 29 will have been turned to "white" position and DSE's 26, 28 and 30 will remain "black". Three sixths of the surface of the display element will therefore be white and three sixths black so that the particular element exactly represents a dot having a grey value of 3.

It will become evident to the man skilled in the art that the described method for transforming an input image to a control means for actuating the display panel can also be performed by other devices which are likewise contemplated by the invention.

The new display panel and method have numerous advantages. The displayed image can be seen in daylight as well as in artificially illuminated rooms and does not need proper illuminating means. The displayed image can be changed very rapidly due to the subdivision of the panel into modules. This advantageous fact permits the display of varying information; for example, sport game results may be displayed followed by an advertisement which is then rapidly replaced by new game results. Image forming information data can readily be stored as a magnetic and/or paper tape so that an image can be repeatedly displayed without necessity of new scanning an input image. Artificial images can be displayed with the same readiness.

Having thus shown and described specific forms which the present invention can assume and the manner in which it may be performed and the utility thereof, it is desired to be understood that such forms were chosen more for the purpose of illustrating the principle and mode of operation rather than for indicating the full scope thereof. It should be emphasized that any modifications, adaptions and alterations may be applied to the specific forms shown, within the scope of the present invention set forth in the appended claims.

What is claimed is:

1. A display system for automatically displaying dot matrix images, said system comprising;

a generally flat display panel having a generally vertical front plane, a panel body and a rear side, said panel being subdivided into a plurality of display modules comprising a plurality of display elements;

display sub-elements disposed in substantially adjacent relationship and forming said display elements, said sub-elements each being rotatable about a respective axis, said axes being generally parallel, and each said sub-element having a dark surface portion and a light surface portion and having actuating means for rotating said sub-element about its respective said axis;

support means rotatably supporting said sub-elements in said front plane of said panel, said support means forming said rear side of said panel; and image setting and resetting means cooperating with said display sub-element actuating means; said image setting and resetting means being adapted to travel behind said modules.

2. A display system for automatically displaying dot matrix images, said system comprising:

a generally flat display panel having a generally vertical front plane, a panel body and a rear side, said panel being subdivided into a plurality of display modules comprising a plurality of rectangularly shaped display elements arranged in rows, each of said display elements comprising a plurality of adjacently disposed, elongated display sub-elements having parallel axes which lie in said front plane of said display panel; each of said sub-elements having a dark and a white surface portion and being rotatable from a dark position in which its said dark surface portion is displayed, to a light position in which its said white surface portion is displayed;

respective display sub-element actuating means fixed to each of said display sub-elements, all said actuating means of each said row of said display sub-elements defining a respective horizontal plane corresponding to said row;

support means supporting said display sub-elements; and respective image setting and resetting means for each said row of said display sub-elements, said image setting and resetting means being adapted to travel behind said actuating means and being adapted to make control movements in a direction perpendicular to said vertical front plane of said display panel.

3. The display system of either of claims 1 or 2, wherein said display modules are generally square shaped, and wherein each said display element comprises six said display sub-elements, said display sub-elements having the shape of hollow rollers; each said actuating means comprising a cylindrical neck on one end of its respective said roller; said rollers being arranged in parallel and substantially adjacent relationship, the length of each said roller, including its said neck, being about equal to six times its diameter; each said roller having a black half-cylindrical surface portion.

4. The display system of claim 2, wherein said image setting and resetting means comprise, for each said row of said display sub-elements: a respective electromagnet having an armature; a generally vertically disposed control bar having said electromagnets mounted thereon; a plurality of contact blades slidably lodged within said control bar, each said contact blade being disposed in such a relationship with a respective said electromagnet armature as to be subject to a magnetic force generated by said armature; each said contact blade having a tongue protruding from said control bar toward said front plane of said display panel and lying in a respective said horizontal plane; and respective spring means biasing each said contact blade away from said armature and against the respective said actuating means.

5. The display system of claim 3, wherein each said display sub-element comprises a hollow roller having a top portion and a bottom portion which has a wider bore than said top portion; said support means comprising a respective supporting stud corresponding to each said display sub-element and rotatably supporting said bottom portion thereof, said stud having a radially directed stop abutment and said bottom portion bore having a radially inward directed nose on its inner surface coplanar with said stop abutment, said nose and said stop abutment cooperating to limit the angle through which said sub-element can rotate to about 180°.

6. A process for automatically displaying a series of dot matrix images on an electromagnetically-energized display panel, said process comprising the following steps:

resetting an existing dot matrix image, comprising a plurality of image elements, on a display panel, said display panel comprising a plurality of display elements each of which corresponds to a respective portion of a dot matrix image displayed on said display panel, to a first condition;

providing a magnetic record of an input image to be displayed on said display panel, said magnetic record comprising dot-by-dot information of the input image and having graded brightness information for each display element of said display panel;

converting said magnetic record into electrical pulses and amplifying said electrical pulses to energize a plurality of electromagnets in an electromagnetic display system comprising said display panel;

converting said brightness information into electrical pulses representative thereof for providing gradations of brightness in said output dot matrix image; and setting an output dot matrix image by utilizing said amplified electrical pulses to energize said electromagnets for bringing selected said display elements into a second condition to define said output dot matrix image on said display panel.

7. The process of claim 6, wherein said converting step further comprises converting said magnetic record into a numerical record of a punched tape, and then converting said numerical record into said electrical pulses for energizing said electromagnets.

8. The process of claim 7, wherein said setting step comprises setting said output dot matrix image by moving said electromagnets behind said display panel, said electromagnets being vertically aligned, to set the rotational position of each of a plurality of prismatic display sub-elements responsive to the generation of magnetic forces in said electromagnets by said electrical pulses, each said display sub-element being rotated or not as a function of whether a respective said electromagnet is energized or not.

9. The process of claim 7, wherein said resetting step comprises resetting said existing dot matrix image by rotating to a reset position each of a plurality of rotatable display sub-elements, which are disposed in a row of columns, by means of a horizontal reset movement of said electromagnets behind said display panel, said electromagnets being vertically aligned.

10. The process of claim 9, wherein said output dot matrix image is defined by display sub-elements in a first rotational position in which they show a first surface portion, and by additional display sub-elements rotated by 180° from said first rotational position to a second rotational position to show a second surface portion, said resetting step being effected by performing said horizontal reset movement of said column of electromagnets while none of said electromagnets is energized, to bring a tongue of a control blade which is retractable by an energized said electromagnet but which is not retracted during said resetting step into contact with a cylindrical actuating neck of each said display sub-element to rotate said display sub-element by 180° to its said first rotational position when it is in its said second rotational position, said tongue frictionally sliding along said actuating neck when said display sub-element is already in its said first rotational position.

11. The process of claim 7 wherein said graded brightness information for each said display element, converted into electrical pulses, is used to set a dot matrix sub-image of said output dot matrix image, defined by dark and light displayed surfaces of a plurality of display sub-elements forming each of said display elements, said dark and light displayed surfaces of said display sub-elements of each said display element being adapted, by their composition, to represent a grey value selected from a plurality of predetermined grey gradations and representative of said brightness information.

12. The process of claim 11 wherein six display sub-elements form a display element, and wherein seven grey steps are provided, including white and black.

13. The process of claim 6 wherein said step of providing said magnetic record comprises scanning an input image in a dot-by-dot manner in linewise sequence, said input image being scanned portionwise, each portion comprising a square-shaped surface area fraction of said input image, each said fraction corresponding to a respective said display element.

14. A process for automatically displaying a series of dot matrix images, said process comprising the following steps:

resetting an existing dot matrix image displayed on a display panel to a first condition, said display panel comprising a plurality of display elements and said resetting step comprising resetting all of said display elements into said first condition;

providing a magnetic record of an input image, said magnetic record comprising dot-by-dot information of the input image;

converting said magnetic record into a numerical record on a punched tape and converting said numerical record into amplified electrical pulses for energizing a plurality of electromagnets for digitally energizing an image forming system comprising said display panel; and utilizing said electrical pulses to energize said electromagnets for bringing selected said display elements to a second condition to display an output dot matrix image representative of the input image on said display panel.

* * * * *